US010418010B2

(12) United States Patent
Hoshino

(10) Patent No.: US 10,418,010 B2
(45) Date of Patent: Sep. 17, 2019

(54) DEVICE CASE, CONNECTOR, AND ELECTRONIC MUSICAL INSTRUMENT

(71) Applicant: CASIO COMPUTER CO., LTD., Tokyo (JP)

(72) Inventor: Akihisa Hoshino, Tokyo (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 116 days.

(21) Appl. No.: 15/409,110

(22) Filed: Jan. 18, 2017

(65) Prior Publication Data

US 2017/0206878 A1 Jul. 20, 2017

(30) Foreign Application Priority Data

Jan. 20, 2016 (JP) ..... 2016-009032

(51) Int. Cl.

| | |
|---|---|
| ***G10H 1/32*** | (2006.01) |
| ***H04R 1/02*** | (2006.01) |
| ***H04R 1/24*** | (2006.01) |
| ***H04R 1/28*** | (2006.01) |
| *H04R 1/26* | (2006.01) |

(52) U.S. Cl.

CPC ..... *G10H 1/32* (2013.01); *H04R 1/025* (2013.01); *H04R 1/24* (2013.01); *H04R 1/2826* (2013.01); *H04R 1/26* (2013.01)

(58) Field of Classification Search

CPC ..... G10H 1/32; H04R 1/2826; H04R 1/24; H04R 1/025; H04R 1/26

USPC ..... 84/744

See application file for complete search history.

(56) References Cited

U.S. PATENT DOCUMENTS

| | | | | |
|---|---|---|---|---|
| 2008/0072747 | A1* | 3/2008 | Nishida | G10H 1/32 84/744 |
| 2010/0147131 | A1* | 6/2010 | Shinjo | G10H 1/32 84/192 |
| 2012/0222541 | A1* | 9/2012 | Ishimura | G10H 1/32 84/744 |
| 2013/0180387 | A1* | 7/2013 | Takahashi | G10H 1/32 84/644 |
| 2013/0283998 | A1* | 10/2013 | Irimura | G10C 3/12 84/423 R |
| 2015/0146905 | A1* | 5/2015 | Abe | H04R 1/086 381/334 |

(Continued)

FOREIGN PATENT DOCUMENTS

| | | |
|---|---|---|
| JP | 05-241574 A | 9/1993 |
| JP | H5-94893 U | 12/1993 |
| JP | 3994326 B2 | 10/2007 |

*Primary Examiner* — Jeffrey Donels

(74) *Attorney, Agent, or Firm* — Chen Yoshimura LLP

(57) ABSTRACT

A device case includes speaker boxes that are formed inside spaces created by placing upper cases that have a larger external shape than a lower case on upper of that lower case, as well as box connectors that are arranged fitting into the speaker boxes in the upper cases so as to contact the ends of peripheral portions of the lower case and fix together the lower case and the upper cases. This makes it possible for the box connectors to seal the spaces between the peripheral portions of the lower case and the peripheral portions of the upper cases. This, in turn, makes it possible to reliably and satisfactorily seal the speaker boxes in an airtight manner even when the external shapes of the lower case and the upper cases that are stacked together are different.

19 Claims, 14 Drawing Sheets

(56) References Cited

U.S. PATENT DOCUMENTS

2016/0105743 A1* 4/2016 Yamazaki ..... H04R 1/2888
381/349

* cited by examiner

DEVICE CASE, CONNECTOR, AND ELECTRONIC MUSICAL INSTRUMENT

BACKGROUND OF THE INVENTION

1. Field of the Invention

The present invention relates to a device case and a connector for use in an electronic device such as an electronic musical instrument or an audio device, and to an electronic musical instrument that includes the device case and connector.

2. Description of the Related Art

One well-known type of musical instrument case for an electronic musical instrument is that disclosed in Patent Document 1, for example, which includes a top case and a bottom case.

In the top case, an upper box frame is arranged surrounding the upper sides of speakers, and in the bottom case, a lower box frame is arranged surrounding the lower sides of the speakers. Together, the upper box frame and the lower box frame form a speaker box.

In Japanese Patent Application Laid-Open Publication No. 05-241574, the speakers are arranged in the rear corners on both sides of the top case. Therefore, the upper box frame of the speaker box includes a peripheral portion of the top case that is arranged near the speakers as well as upper partitions that are arranged inside of the top case and surround the sides of the speakers. Similarly, the lower box frame includes a peripheral portion of the bottom case that is arranged near the speakers as well as lower partitions that are arranged inside of the bottom case and surround the sides of the speakers.

In this type of musical instrument case, when the top case is placed on top of the bottom case, the upper box frame of the top case and the lower box frame of the bottom case contact and fit together with one another, and the top case and the bottom case are then fixed together in this state in order to form the speaker box.

However, in this type of musical instrument case, if the external shape of the top case is different than the external shape of the bottom case, then when the top case is placed on top of the bottom case, the peripheral portion of the top case will not fit together with the peripheral portion of the bottom case, thereby creating a gap between the peripheral portion of the top case and the peripheral portion of the bottom case and preventing the speaker box from forming an airtight seal around the speakers.

The problem to be solved by the present invention is therefore to provide a device case, a connector, and an electronic musical instrument including the device case and connector that make it possible to seal the box in an airtight manner even when the cases that are stacked together are of different shapes.

Accordingly, the present invention is directed to a scheme that substantially obviates one or more of the problems due to limitations and disadvantages of the related art.

SUMMARY OF THE INVENTION

Additional or separate features and advantages of the invention will be set forth in the descriptions that follow and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, in one aspect, the present disclosure provides an electronic musical instrument, including: a device case including: a lower case having a first mounting portion; an upper case having a second mounting portion disposed in a position corresponding to the first mounting portion; a connector positioned inside the upper case and having a sealing portion that seals in an airtight manner a gap between a peripheral portion of the lower case and an inner surface of a peripheral portion of the upper case, the connector further having a mounting portion positioned between the first mounting portion and the second mounting portion; and a fixing member that fixes together the first mounting portion, the mounting portion of the connector, and the second mounting portion, and a keyboard mounted on the lower case and exposed to outside.

In another aspect, the present disclosure provides a device case, including: a lower case having a first mounting portion; an upper case having a second mounting portion disposed in a position corresponding to the first mounting portion; a connector positioned inside the upper case and having a sealing portion that seals in an airtight manner a gap between a peripheral portion of the lower case and an inner surface of a peripheral portion of the upper case, the connector further having a mounting portion positioned between the first mounting portion and the second mounting portion; and a fixing member that fixes together the first mounting portion, the mounting portion of the connector, and the second mounting portion.

In another aspect, the present disclosure provides a connector for use in a device case that includes a lower case having a first mounting portion and an upper case having a second mounting portion at a position corresponding to the first mounting portion, the connector including: a sealing portion positioned inside the upper case and sealing in an airtight manner a gap between a peripheral portion of the lower case and an inner surface of a peripheral portion of the upper case; and a mounting portion positioned between the first mounting portion and the second mounting portion, the first mounting portion, the mounting portion of the connector, and the second mounting portion being fixed together by a fixing member.

In the present invention, the connector is arranged between the peripheral portion of the upper case and the peripheral portion of the lower case such that the connector fits together with an edge of the peripheral portion of the lower case and also contacts an inner surface of the peripheral portion of the upper case, thereby making it possible for the connector to connect together the upper case and the lower case in an airtight manner even when the external shape of the upper case is different than the external shape of the lower case.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE DRAWING

The accompanying drawings, which are incorporated in and constitute a part of the specification, illustrate embodiments of the invention, and together with the general description given above and the detailed description of the embodiments given below, serve to explain the principles of the invention.

FIG. 7A is an enlarged cross-sectional view of the main components of the speaker as taken along line A-A in FIG. 5.

FIG. 7B is an enlarged rear view of the speaker, and FIG. 7C is an enlarged side view of a speaker cushioning member illustrated in FIG. 7A.

FIG. 8A is an enlarged cross-sectional view of the main components of the tweeter as taken along line B-B in FIG. 5. FIG. 8B is an enlarged plan view of a tweeter mounting member, and FIG. 8C is an enlarged side view of a tweeter cushioning member illustrated in FIG. 8A.

FIG. 9A is an enlarged perspective view, and FIG. 9B is an enlarged cross-sectional view of the main components of the bass reflex port as taken along line C-C in FIG. 2.

FIG. 10A is an enlarged cross-sectional view of the main components of the bass reflex port as taken along line D-D in FIG. 2, and FIG. 10B is an enlarged rear view of the main components of a port cushioning member.

FIG. 11A is an enlarged perspective view, and FIG. 11B is an enlarged cross-sectional view of the main portions of the connector as taken along line F-F in FIG. 11A.

FIG. 14A is an enlarged perspective view. FIG. 14B is an enlarged cross-sectional view of the main portions of the connector as taken along line F1-F1 in FIG. 14A, and FIG. 14C is an enlarged cross-sectional view of the main components of a top case that uses this connector as taken along line E1-E1.

DETAILED DESCRIPTION OF EMBODIMENTS

Next, an embodiment in which the present invention is applied to an electronic keyboard will be described with reference to FIGS. 1 to 14C.

Figure 1:
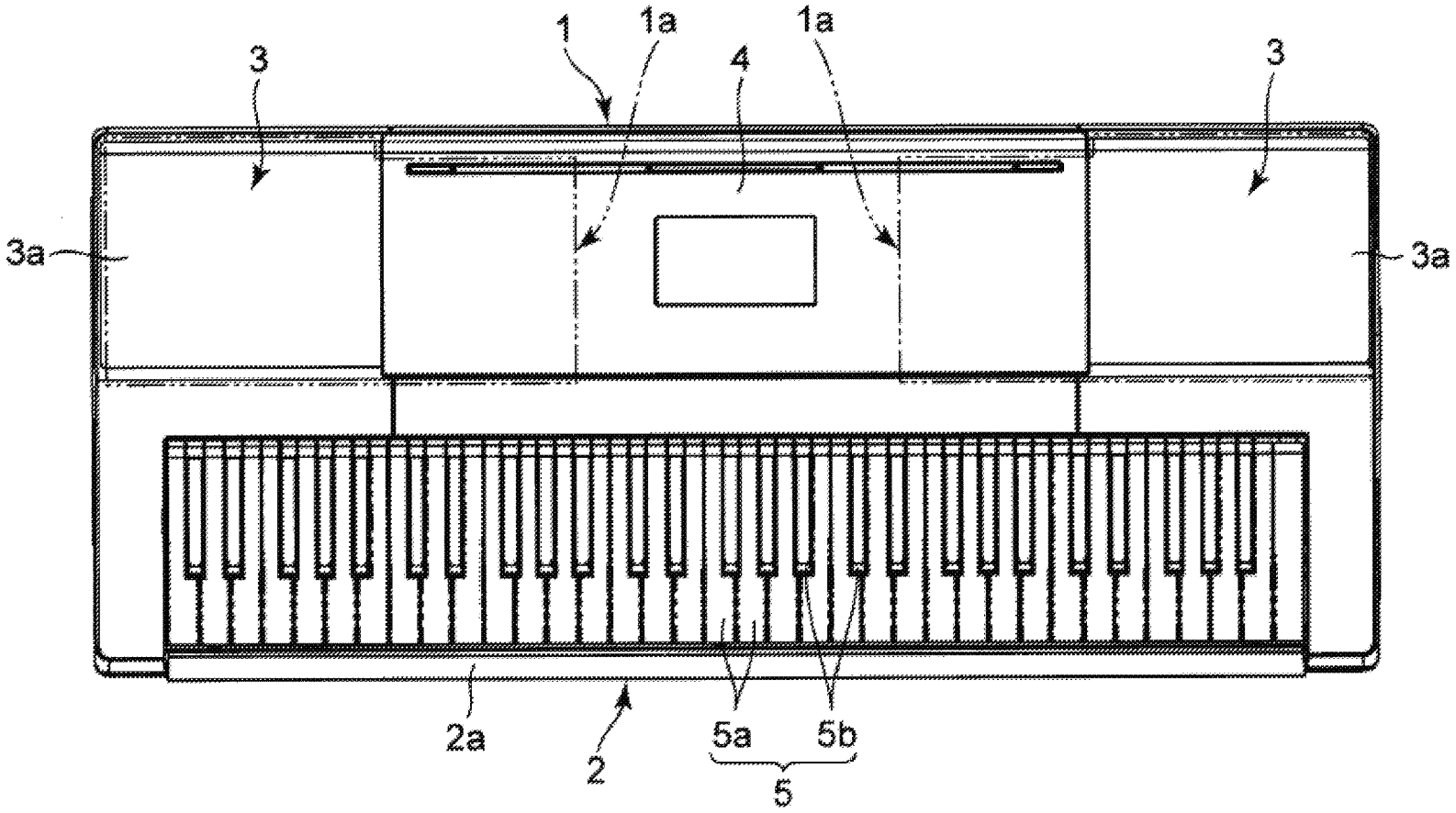
FIG. 1 is a front view illustrating an embodiment in which the present invention is applied to an electronic keyboard.
Figure 2:
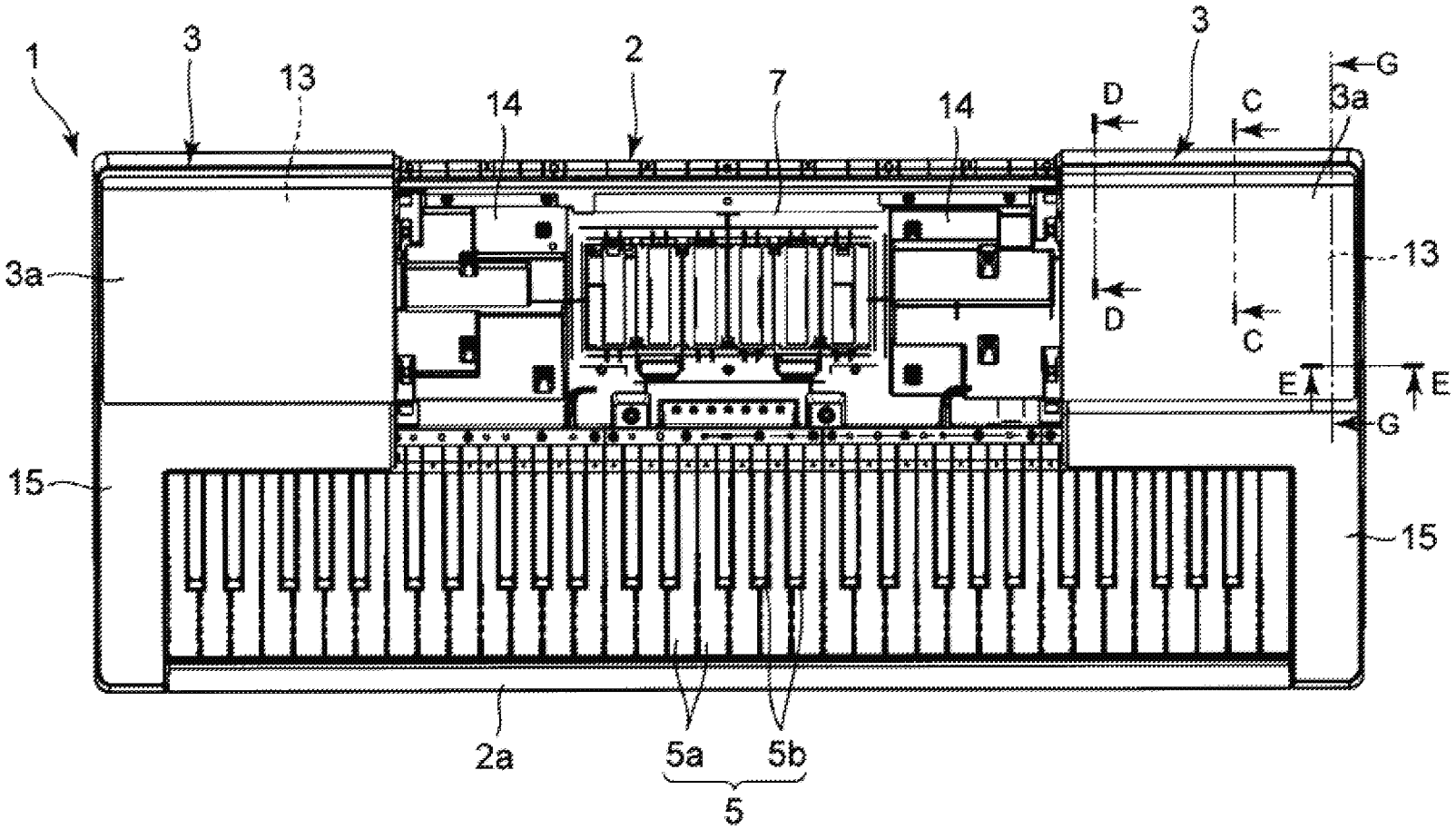
FIG. 2 is a front view illustrating the electronic keyboard illustrated in FIG. 1 in a state in which a center panel has been removed.
Figure 3:
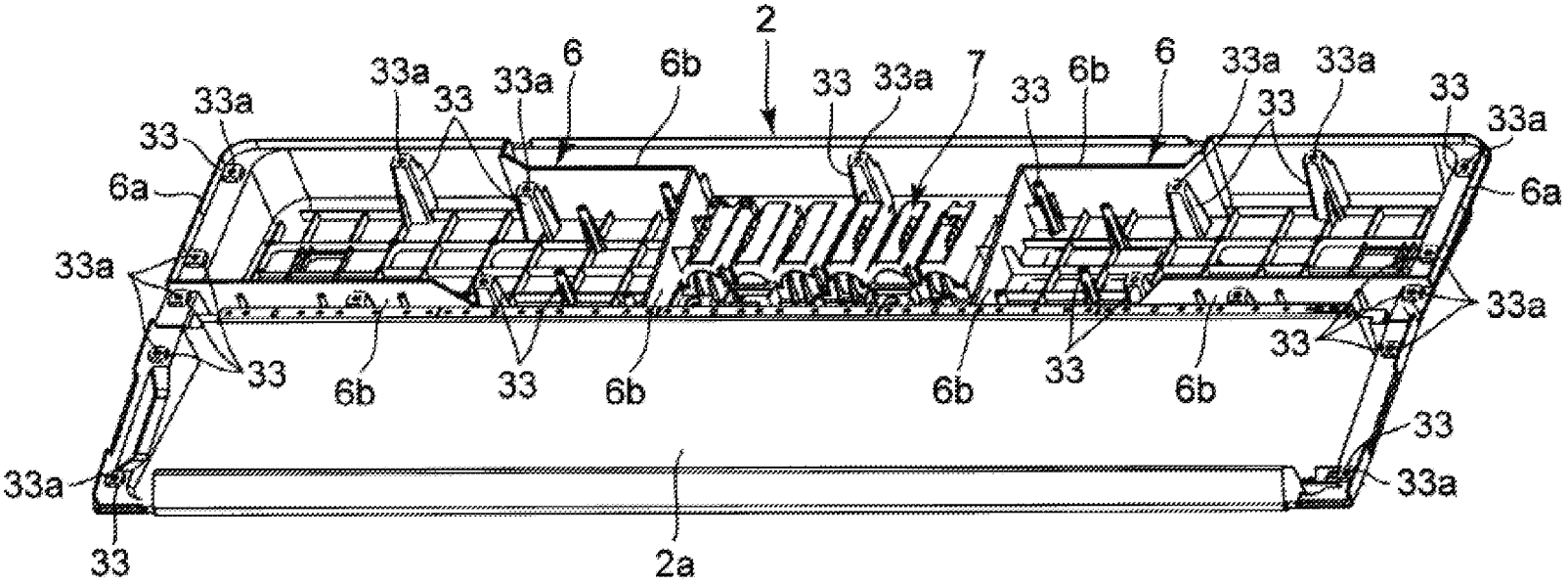
FIG. 3 is perspective view illustrating a bottom case of the electronic keyboard illustrated in FIG. 2 after top cases and a keyboard have been removed.

As illustrated in FIGS. 1 to 3, the electronic keyboard includes a musical instrument case 1. The musical instrument case 1 includes a lower case (bottom case) 2, upper cases (top cases) 3, and a center panel 4, and speaker boxes 1*a* are formed inside of these components.

As illustrated in FIG. 3, the bottom case 2 has a box shape that is open on the upper side and is elongated in the left-to-right direction. As illustrated in FIGS. 1 and 2, a keyboard mounting portion 2*a* for mounting a keyboard 5 is formed in the front side of the bottom case 2. The keyboard 5 includes white keys 5*a* and black keys 5*b* that are arranged along the lengthwise direction of the bottom case 2 on a keyboard chassis (not illustrated in the figures), and the keyboard chassis is mounted on the keyboard mounting portion 2*a*.

Moreover, as illustrated in FIG. 3, first box frames 6 are formed on both ends of the rear side of the bottom case 2 as lower box frames that form the lower sides of the speaker boxes 1*a*. A battery compartment 7 is formed in the center of the rear side of the bottom case 2. The battery compartment 7 houses a plurality of batteries (not illustrated in the figure).

Here, as illustrated in FIG. 3, each of the first box frames 6 includes a peripheral portion 6*a* that is positioned along the upper and left or right sides of the bottom case 2 and a first frame-shaped rib 6*b* that functions as a lower frame-shaped rib. The first frame-shaped ribs 6*b* are formed along the boundary of the keyboard 5 and along the boundaries of the battery compartment 7. Moreover, gaskets 8 (see FIG. 12A) that provide enhanced airtightness due to their own cushioning properties are formed running around the entire upper ends of the peripheral portions 6*a* and the entire upper ends of the first frame-shaped ribs 6*b* of the bottom case 2.

As illustrated in FIG. 2, the top cases 3 are formed such that the external shapes thereof are larger than the external shape of the bottom case 2. As illustrated in FIGS. 2 to 5, a speaker 10, a tweeter 11, and a bass reflex port 12 are arranged inside each of the top cases 3, and the top cases 3 are arranged on top of the bottom case 2 on both sides thereof. In other words, the top cases 3 are aligned with the first box frames 6 of the bottom case 2 and both sides of the keyboard 5 and then fixed on top of the bottom case 2.

Here, as illustrated in FIGS. 2 to 5, each of the top cases 3 includes a main case portion 13 in which the speaker 10, the tweeter 11, and the bass reflex port 12 are arranged; a box extension 14 that extends out from the main case portion 13 towards the battery compartment 7; and a cover 15 that covers one of the sides of the keyboard 5, and these components are formed as a single integrated body made of a synthetic resin.

Figure 4:
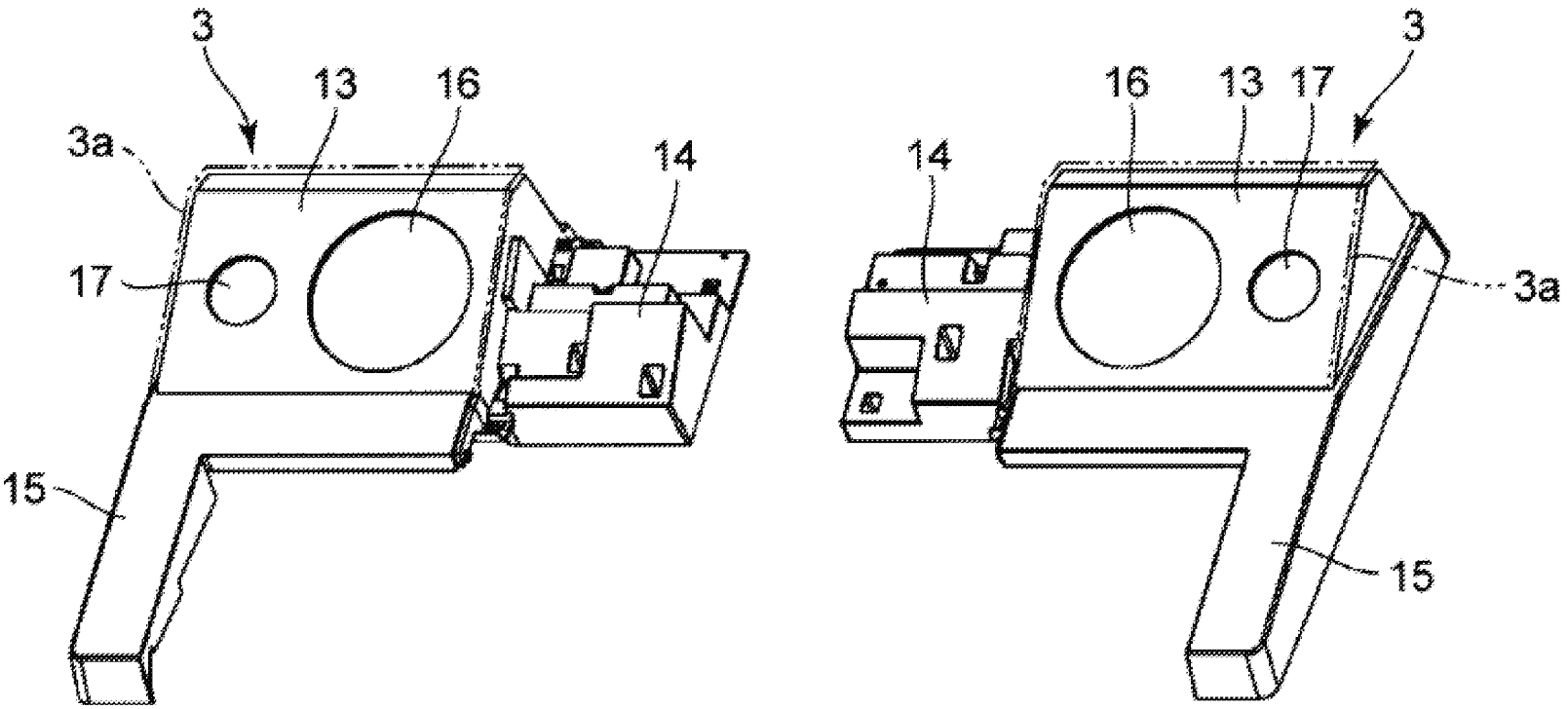
FIG. 4 is perspective view illustrating the left and right top cases of the electronic keyboard illustrated in FIG. 2.

As illustrated in FIG. 4, the upper surface of the main case portion 13 of each top case 3 is formed as a slanted surface in which the height of the surface increases moving from the rear end of the cover 15 towards the rear surface side of the top case 3. A cover panel 3*a* is formed in the upper surface of each main case portion 13. Moreover, as illustrated in FIGS. 5 and 6, a second box frame 9 that forms the upper side of the respective speaker box 1*a* is formed in each main case portion 13 at a position substantially corresponding to the respective first box frame 6, and a reinforcing rib 3*b* is formed inside of the second box frame 9.

Figure 5:
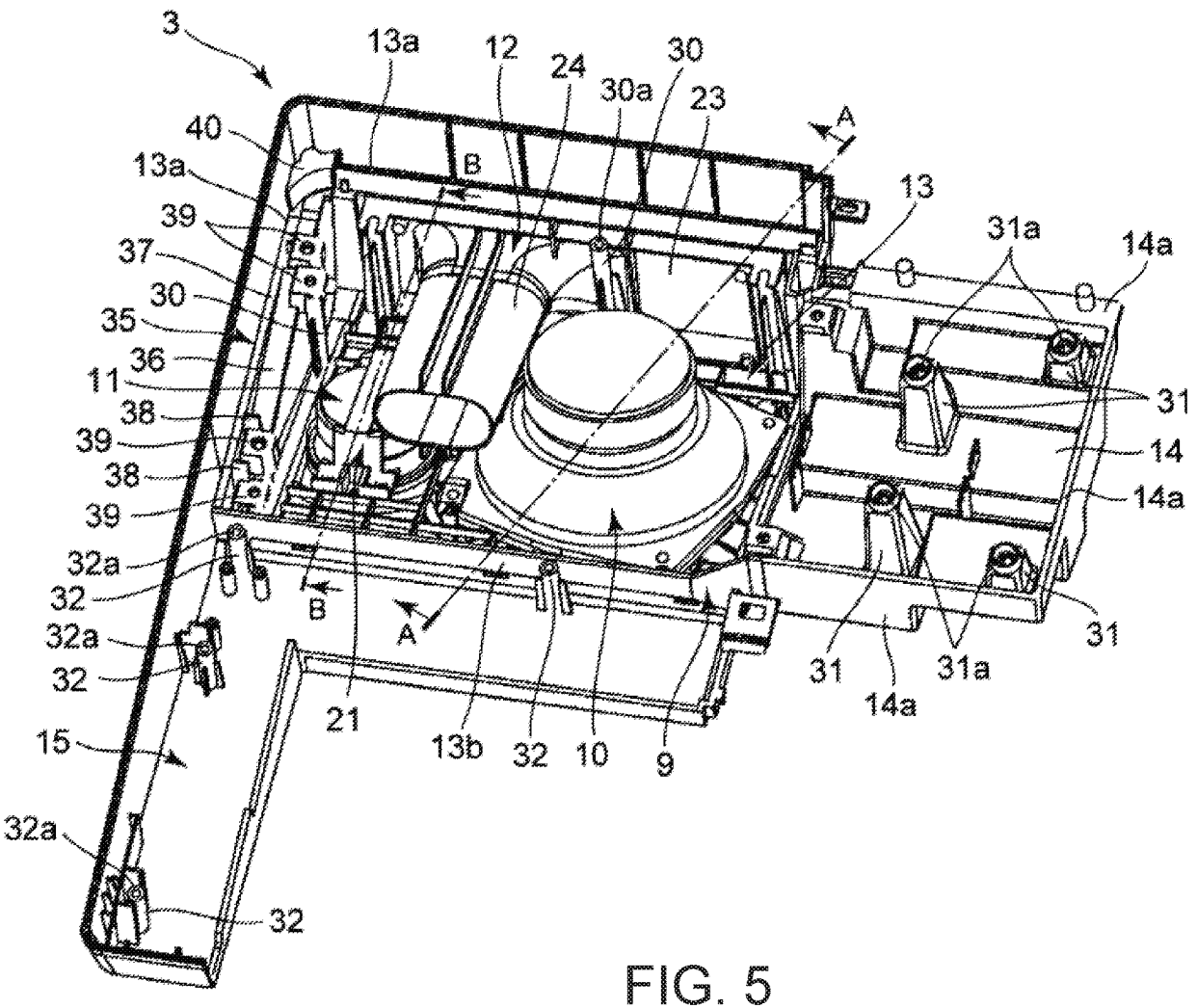
FIG. 5 is an enlarged perspective view illustrating one of the top cases illustrated in FIG. 4 in a vertically inverted state.
Figure 6:
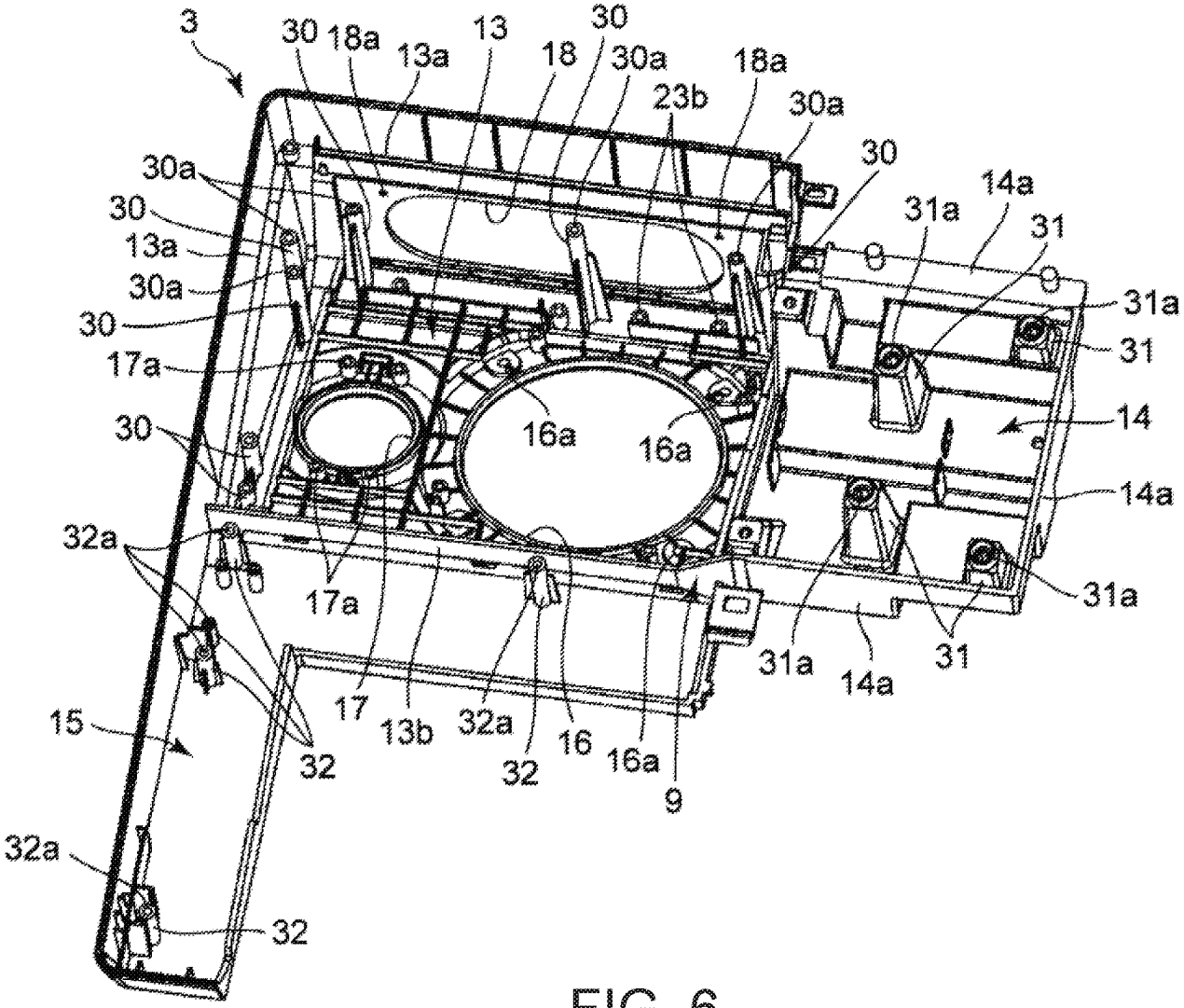
FIG. 6 is an enlarged perspective view illustrating the top case illustrated in FIG. 5 after a speaker, a tweeter, a bass reflex port, and a connector have been removed.

As illustrated in FIGS. 5 and 6, the second box frame 9 includes a peripheral portion 13*a* that is positioned along the upper side and a side in the left-to-right direction and a second frame-shaped rib 13*b*. The second frame-shaped rib 13*b* is formed connecting between the boundary of the cover 15 of the top case 3 and the boundary of the battery compartment 7 at a position that corresponds to the respective first frame-shaped rib 6*b* of the bottom case 2.

In this way, when the top cases 3 are placed on top of the bottom case 2, the first box frames 6 and the second box frames 9 fit together vertically, thereby forming the speaker boxes 1*a* that are enclosed by the first box frames 6 and the second box frames 9 inside of the musical instrument case 1.

Furthermore, as illustrated in FIGS. 4 and 6, a speaker opening 16 and a tweeter opening 17 are formed in the upper surface of the main case portion 13 of each of the top cases 3. Moreover, a port opening 18 is formed in the rear surface of each of the top cases 3. Here, as illustrated in FIGS. 6 and 7A, a plurality of speaker mounting bosses 16*a* for attaching the speakers 10 are formed around the periphery of the speaker opening 16 in the inner surface of each top case 3.

Figure 8A:
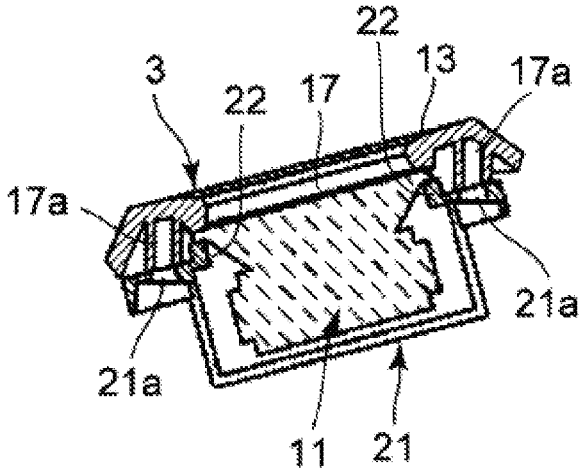
FIGS. 8A to 8C illustrate the tweeter illustrated in FIG. 5.
Figure 10A:
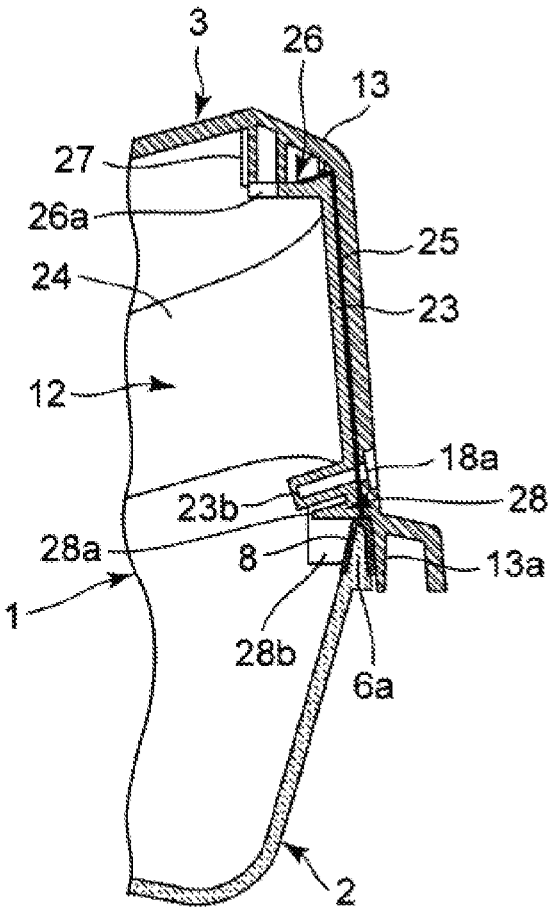
FIGS. 10A and 10B illustrate the bass reflex port illustrated in FIG. 9A.

Moreover, as illustrated in FIGS. 6 and 8A, a plurality of tweeter mounting bosses 17*a* for attaching the tweeters 11 are formed around the periphery of the tweeter opening 17 in the inner surface of each top case 3. Furthermore, as illustrated in FIGS. 6 and 10A, a plurality of port mounting holes 18*a* for attaching the bass reflex ports 12 are formed around the periphery of the port opening 18 in the rear surface of each top case 3.

Figure 7A:
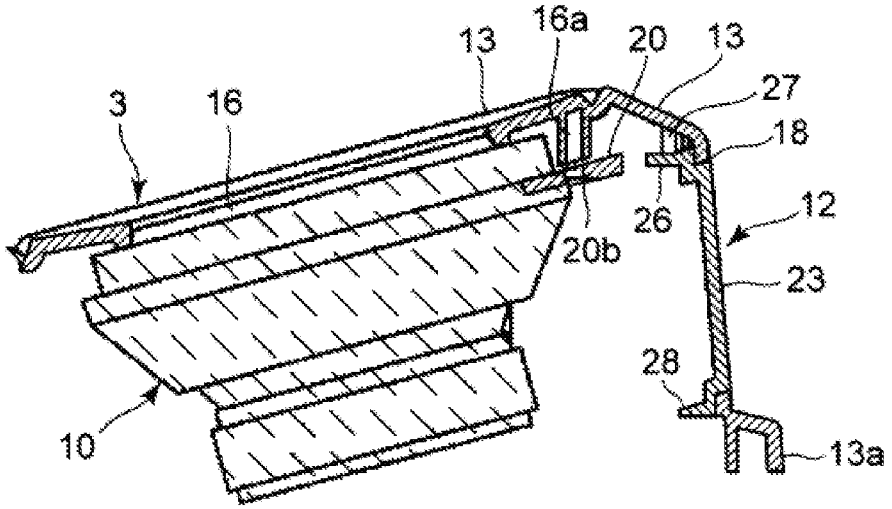
FIGS. 7A to 7C illustrate the speaker illustrated in FIG. 5.
Figure 7B:
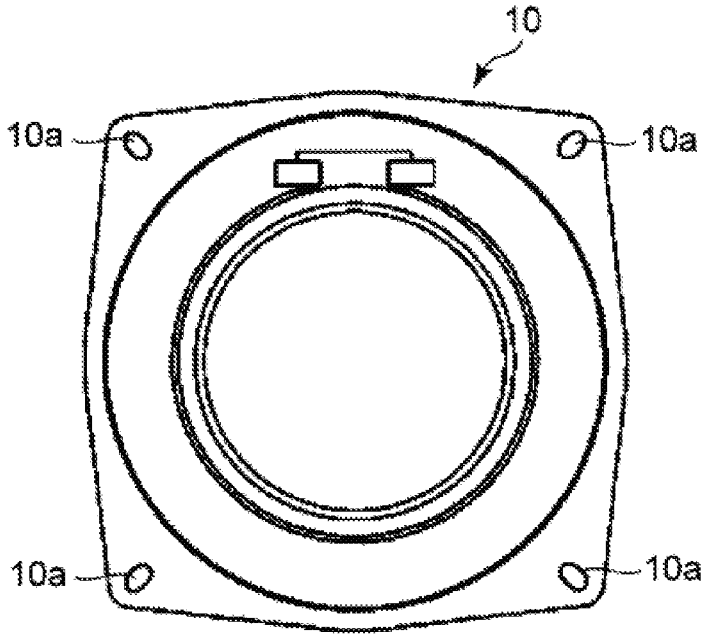
Figure 7C:
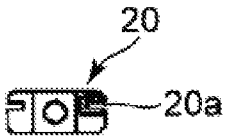

Here, as illustrated in FIG. 7B, mounting holes 10*a* are formed in the four corners of the speakers 10 at positions corresponding to the speaker mounting bosses 16*a* in the top cases 3. As illustrated in FIGS. 7A and 7C, ring-shaped speaker cushioning members 20 are seated in the mounting holes 10*a* in the speakers 10. A screw insertion hole 20*b* through which a screw (not illustrated in the figures) can be inserted is formed in the center of each of the speaker cushioning members 20, and a ring-shaped seating groove 20*a* is formed in the outer peripheral surface of each of the speaker cushioning members 20.

In this way, as illustrated in FIGS. 7A to 7C, the speaker cushioning members 20 are seated in the mounting holes 10*a* in the speakers 10 by elastically deforming the speaker cushioning members 20 and inserting them into the mounting holes 10*a* such that the peripheries of the mounting holes 10*a* are seated within and sandwiched by the seating grooves 20*a* of the inserted speaker cushioning members 20.

Moreover, as illustrated in FIG. 7A, each speaker 10 is attached to the inner surface of the respective top case 3 by fitting the upper face of the speaker 10 onto the speaker opening 16 and aligning the screw insertion holes 20*b* of the speaker cushioning members 20 that are seated in the mounting holes 10*a* with the speaker mounting bosses 16*a*, and then threading screws (not illustrated in the figure) through the screw insertion holes 20*b* in the speaker cushioning members 20 and into the speaker mounting bosses 16*a*.

As illustrated in FIG. 8A, a tweeter mounting member 21 is used to attach each of the tweeters 11 to the inner surface of the respective top case 3. In other words, the tweeter mounting member 21 is arranged under the bottom surface of the tweeter 11 and extending along the side faces of the tweeter 11 towards the inner surface of the top case 3, with both of these side extension portions bending outwards to meet tweeter mounting bosses 17*a* formed in the inner surface of the top case 3. Screws are inserted into the tweeter mounting bosses 17*a* in the top case 3 to attach the tweeter mounting member 21 thereto.

Figure 8B:
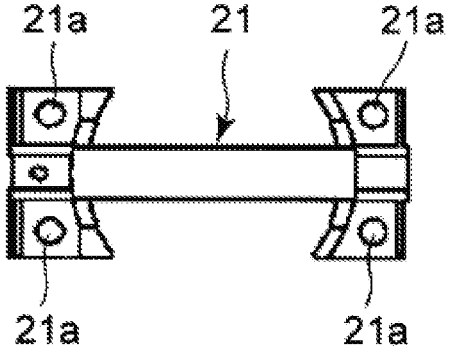

Here, as illustrated in FIG. 8B, mounting holes 21*a* are formed in the tweeter mounting member 21 at positions corresponding to the plurality of tweeter mounting bosses 17*a*, with the mounting holes 21*a* aligned with the tweeter mounting bosses 17*a* with a tweeter cushioning member 22 interposed therebetween. The tweeter cushioning member 22 is ring-shaped and has mounting tabs 22*a* formed in the periphery thereof. These mounting tabs 22*a* are arranged between the plurality of tweeter mounting bosses 17*a* such that the tweeter cushioning member 22 runs around the periphery of the upper surface of the tweeter 11.

Figure 8C:
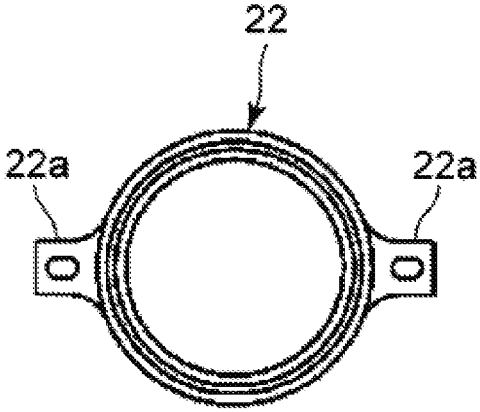

In this way, as illustrated in FIGS. 8A to 8C, the tweeter cushioning member 22 is arranged running around the periphery of the tweeter opening 17 in the inner surface of the top case 3, and the tweeter mounting member 21 supports the tweeter 11, with the tweeter mounting member 21 aligned with the tweeter mounting bosses 17*a* in the top case 3 such that the tweeter cushioning member 22 is sandwiched between the tweeter 11 and the top case 3. Screws are then threaded through the mounting holes 21*a* in the tweeter mounting member 21 and into the tweeter mounting bosses 17*a* in order to attach the tweeter 11 to the inner surface of the top case 3.

Figure 9A:
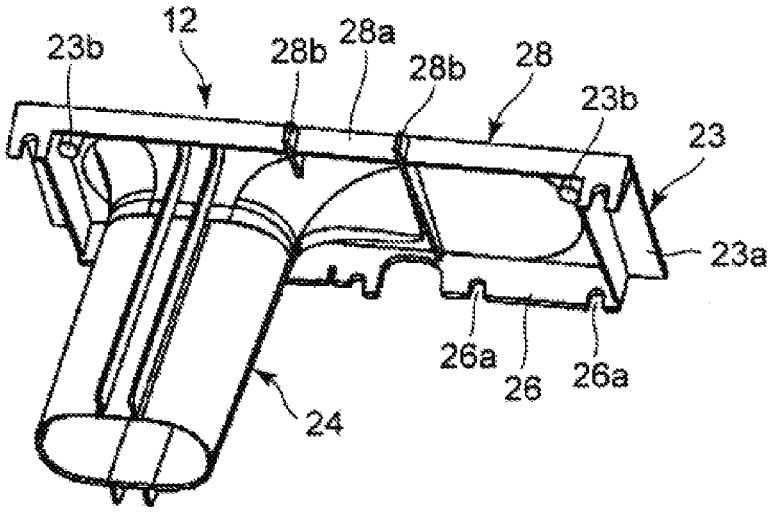
FIGS. 9A and 9B illustrate the bass reflex port illustrated in FIG. 5.
Figure 9B:
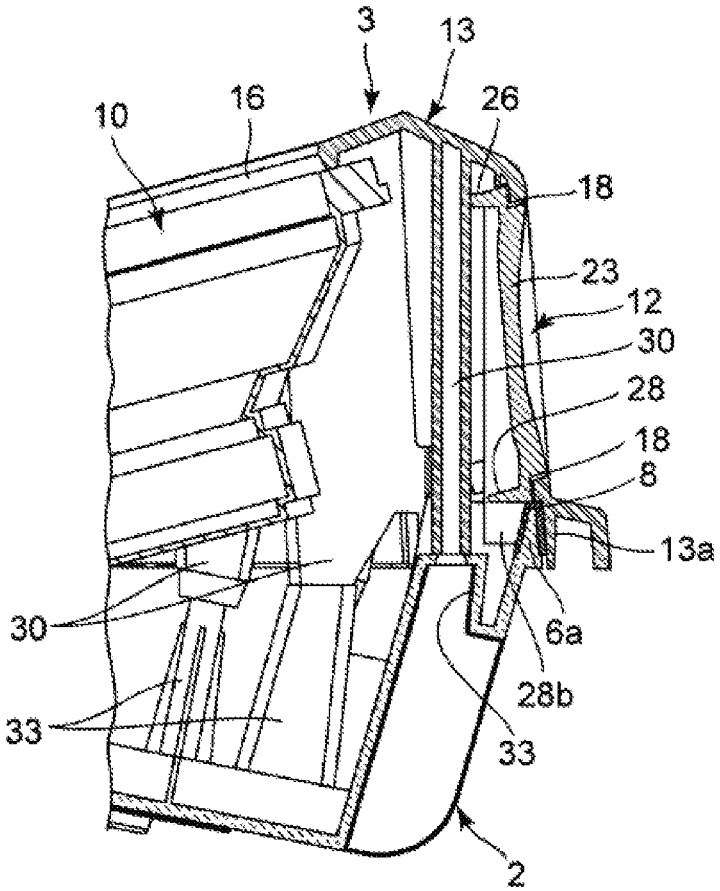

As illustrated in FIG. 9A, each bass reflex port 12 includes a port mounting portion 23 and a port 24, which are formed as a single integrated body and made of a synthetic resin. Here, the port 24 is integrated with the inner surface of the port mounting portion 23 and is formed in the shape of an elliptical tube that is open to the external environment. When the port mounting portion 23 is mounted to the rear surface of the top case 3, the port 24 is positioned between the speaker 10 and the tweeter 11.

Moreover, as illustrated in FIGS. 6, 9A, and 10A, the port mounting portion 23 includes a plate 23*a* fitting onto the port opening 18 in the top case 3 and is mounted to the top case 3 by arranging the plate 23*a* on the inner side of the rear surface of the top case 3 with a port cushioning member 25 interposed therebetween and then inserting screws into port mounting holes 18*a* formed in the top case 3. In other words, a plurality of port mounting bosses 23*b* that extend towards an inner surface side and correspond to the port mounting holes 18*a* in the top case 3 are formed in the plate 23*a* of the port mounting portion 23.

Figure 10B:
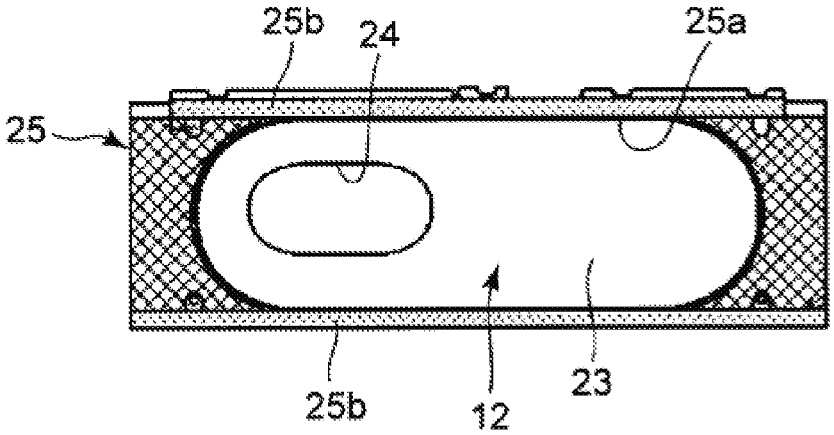
Figure 11A:
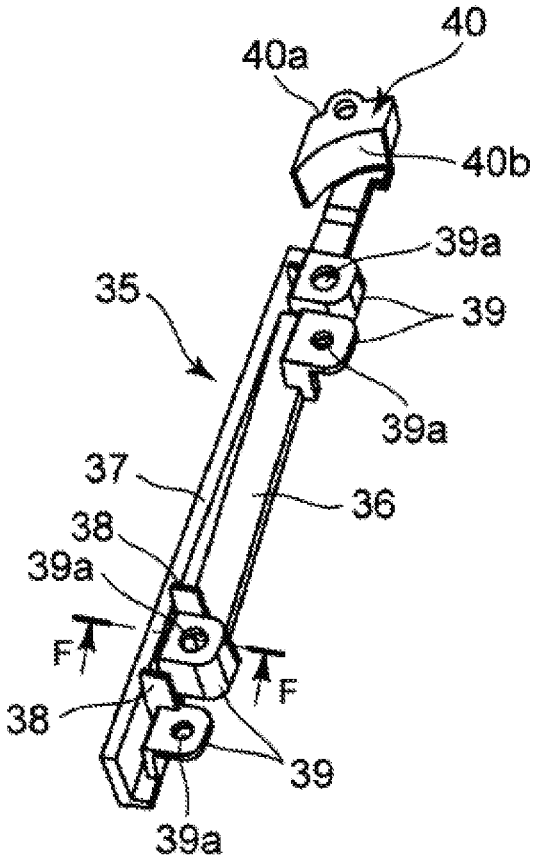
FIGS. 11A and 11B illustrate the connector illustrated in FIG. 5.
Figure 11B:
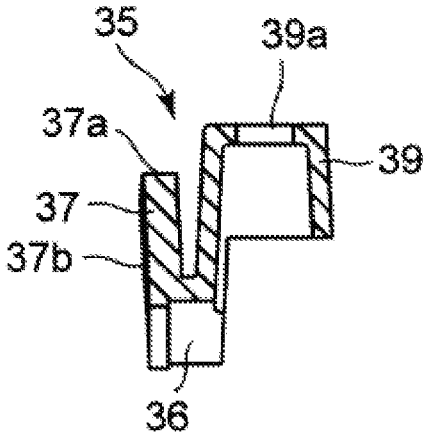

Here, as illustrated in FIGS. 10A and 10B, the port cushioning member 25 is an elastic sheet made of rubber or the like and is arranged on the outer surface of the port mounting portion 23. An elliptical opening 25*a* corresponding to the port opening 18 in the top case 3 is formed in the port cushioning member 25. Moreover, elastic portions 25*b* are formed above and below the opening 25*a* in the port cushioning member 25.

Meanwhile, as illustrated in FIGS. 6, 9A, and 10A, a port fastening tab 26 for fastening the port mounting portion 23 to the main case portion 13 of the top case 3 is formed in the upper end (the lower end in FIG. 9A) of the port mounting portion 23 and faces the inner side of the upper surface of the top case 3. A plurality of cutouts 26*a* are formed in the port fastening tab 26 and correspond to a plurality of port mounting bosses 27 formed in the inner side of the upper surface of the main case portion 13.

In this way, as illustrated in FIGS. 6, 9A, and 10A, the cutouts 26*a* in the port fastening tab 26 are aligned with the port mounting bosses 27 in the main case portion 13, and screws (not illustrated in the figures) are threaded through the cutouts 26*a* and into the port mounting bosses 27 in order to fasten the port fastening tab 26 to the port mounting bosses 27, thereby mounting the port mounting portion 23 to the main case portion 13 of the top case 3.

Furthermore, as illustrated in FIGS. 6, 9A, and 10A, a port connector 28 is formed in the lower end (the upper end in FIG. 9A) of the port mounting portion 23 and faces the bottom case 2. The port connector 28 includes a port contacting portion 28*a* that contacts the upper end of the respective peripheral portion 6*a* of the bottom case 2 and port pressing ribs 28*b* that press the outer surface of the peripheral portion 6*a* of the bottom case 2 against the inner surface of the peripheral portion 13*a* of the top case 3.

Here, as illustrated in FIGS. 6, 9A, and 10A, when the top cases 3 are placed on top of the bottom case 2, the port contacting portions 28*a* contact the upper ends of the peripheral portions 6*a* of the bottom case 2 in order to fill the gaps created between the outer surfaces of the peripheral portions 6*a* of the bottom case 2 and the inner surfaces of the peripheral portions 13*a* of the top cases 3. Moreover, when the top cases 3 are placed on top of the bottom case 2, the port pressing ribs 28*b* press the outer surfaces of the peripheral portions 6*a* of the bottom case 2 against the inner surfaces of the peripheral portions 13*a* of the top cases 3.

In this way, as illustrated in FIGS. 6, 9A, and 10A, when the top cases 3 are placed on top of the bottom case 2, the upper ends of the peripheral portions 6*a* of the bottom case 2 contact the port contacting portions 28*a* of the port connectors 28, with the gaskets 8 interposed therebetween, and the port pressing ribs 28*b* of the port connectors 28 press the outer surfaces of the peripheral portions 6*a* of the bottom case 2 against the inner surfaces of the peripheral portions 13*a* of the top cases 3, with the gaskets 8 interposed therebetween. Therefore, the port connector 28 of each port mounting portion 23 has substantially the same functionality as a box connector 35 (described later).

Furthermore, as illustrated in FIGS. 5 and 6, a plurality of second mounting portions 30 that function as speaker bosses, a plurality of extension bosses 31, and a plurality of cover bosses 32 are formed in the inner side of the upper surface of the top case 3. Screw holes 30*a* are respectively formed in the ends of the plurality of second mounting portions 30. Moreover, screw holes 31*a* are respectively formed in the ends of the plurality of extension bosses 31, and screw holes 32*a* are respectively formed in the ends of the plurality of cover bosses 32.

Figure 12A:
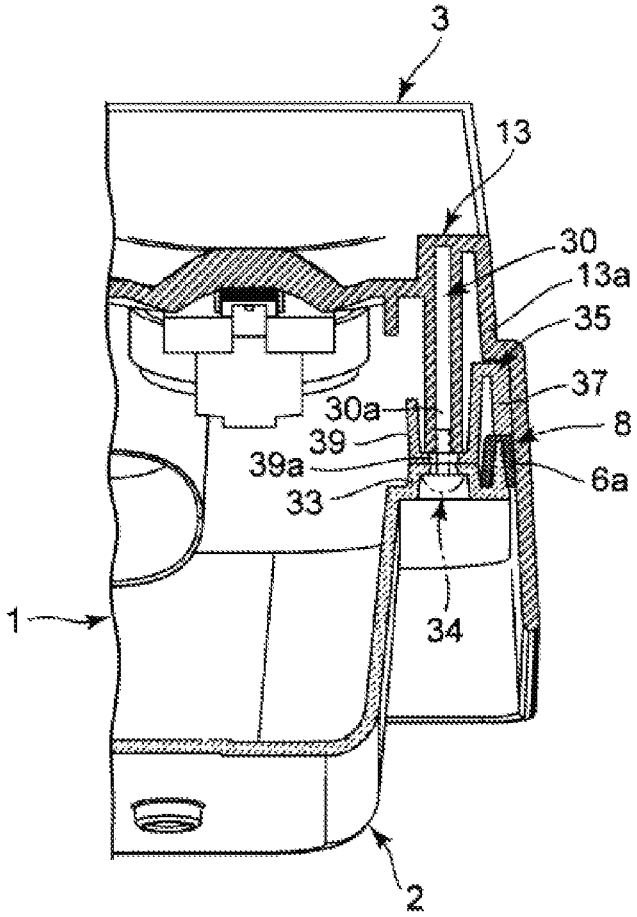
FIG. 12A is an enlarged cross-sectional view of the main components of the top case illustrated in FIG. 2 as taken along line E-E.
Figure 12B:
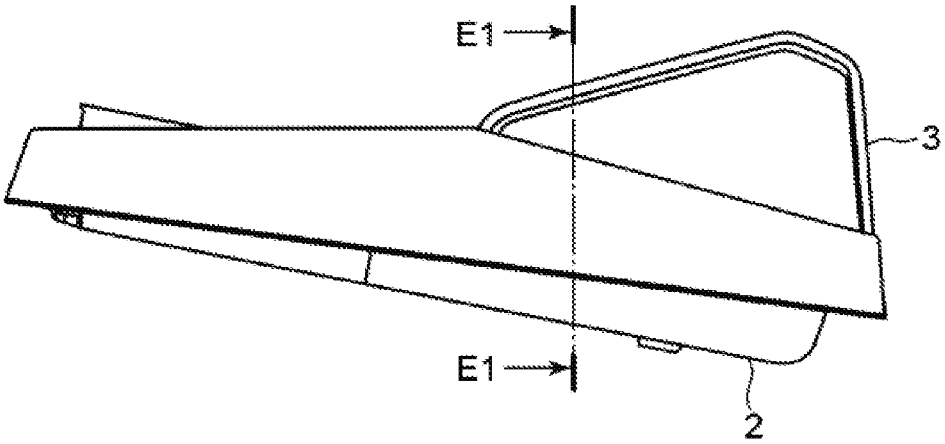
FIG. 12B is a side view of the electronic keyboard illustrated in FIG. 2.
Figure 13:
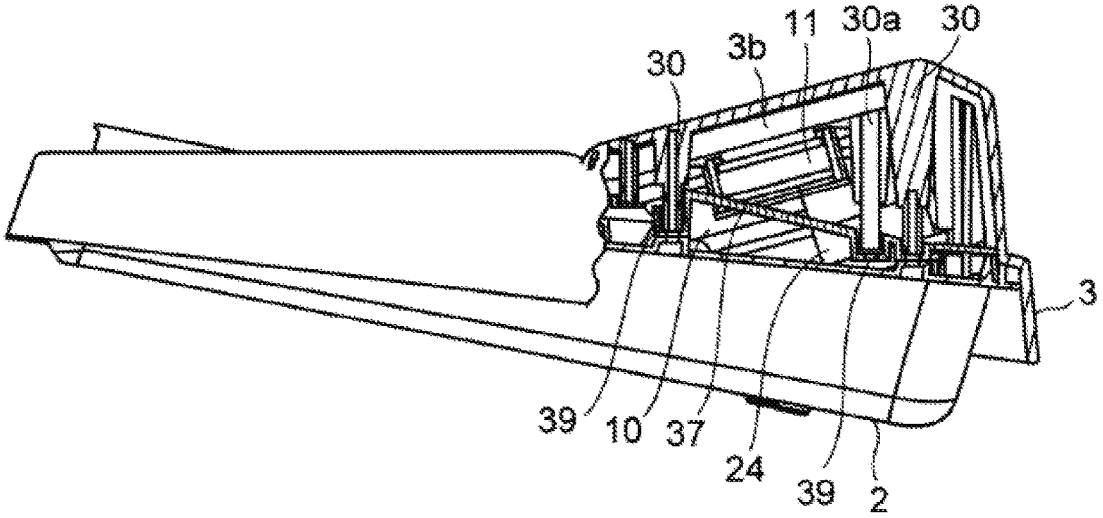
FIG. 13 is an enlarged cross-sectional view of the main components of the electronic keyboard illustrated in FIG. 2 as taken along line G-G.

Meanwhile, as illustrated in FIG. 3, a plurality of first mounting portions 33 that function as lower bosses and respectively correspond to the second mounting portions 30, the extension bosses 31, and the cover bosses 32 in the top cases 3 are formed in the bottom of the bottom case 2. The plurality of first mounting portions 33 each have a tube shape in which the lower end is open to the bottom surface of the bottom case 2 and the upper end has a screw insertion hole 33*a* formed therein. As illustrated in FIG. 12A, screws 34 are inserted into the first mounting portions 33 from the bottom side of the bottom case 2 and protrude upwards from the screw insertion holes 33*a* in the upper ends of the first mounting portions 33.

In this way, as illustrated in FIG. 12A, when the top cases 3 are placed on top of the bottom case 2, the plurality of second mounting portions 30, the plurality of extension bosses 31, and the plurality of cover bosses 32 formed in the top cases 3 respectively align with the plurality of first mounting portions 33 formed in the bottom case 2, and the screws 34 are then inserted into the first mounting portions 33 from the bottom side of the bottom case 2 and threaded into the screw holes 30*a*, 31*a*, and 32*a* in the second mounting portions 30, the extension bosses 31, and the cover bosses 32 of the top cases 3 in order to attach the top cases 3 to the bottom case 2.

Here, as illustrated in FIGS. 3 and 5, the bottom case 2 has a different external shape than the top cases 3. Therefore, box connectors 35 are arranged between the plurality of second mounting portions 30 positioned on the peripheral portion 13*a* sides of the top cases 3 and the corresponding first mounting portions 33 in the bottom case 2 in order to form the speaker boxes 1*a* in the regions enclosed by the first box frames 6 of the bottom case 2 and the second box frames 9 of the top cases 3.

As illustrated in FIGS. 5 and 11A to 13, the box connectors 35 are arranged between the peripheral portions 6*a* of the bottom case 2 and the peripheral portions 13*a* of the top cases 3 in order to fix the top cases 3 to the bottom case 2. The box connectors 35 are arranged between the first mounting portions 33 of the bottom case 2 and the second mounting portions 30 of the top cases 3 and contact the upper ends of the peripheral portions 6*a* of the bottom case with the gaskets 8 interposed therebetween such that the outer surfaces of the peripheral portions 6*a* of the bottom case 2 are pressed into the inner surfaces of the peripheral portions 13*a* of the top cases 3.

In other words, as illustrated in FIGS. 5 and 11A to 13, each of the box connectors 35 includes a main connector portion 36 that is arranged in the top case 3, a sealing portion 37 that contacts the upper end of the peripheral portion 6*a* of the bottom case 2 with the gasket 8 interposed therebetween in order to seal the gap between the peripheral portion 6*a* of the bottom case 2 and the inner surface of the peripheral portion of the top case 3 in an airtight manner, connector pressing portions 38 that function as connector pressing ribs that press the outer surface of the peripheral portion 6*a* of the bottom case 2 against the inner surface of the peripheral portion 13*a* of the top case 3, connector mounting portions 39 that function as connector mounting bosses and are arranged between the first mounting portions 33 of the bottom case 2 and the second mounting portions 30 of the top case 3, and a corner piece 40 that is arranged between a corner of the peripheral portion 13*a* of the top case 3 and the corner of the peripheral portion 6*a* of the bottom case 2.

As illustrated in FIGS. 5 and 11A to 13, the sealing portion 37 has a first face 37*a* that faces the upper end of the peripheral portion of the bottom case 2 and a second face 37*b* that faces the inner surface of the peripheral portion of the top case 3 (a first inner surface) when the first face 37*a* is facing the upper end of the peripheral portion of the bottom case 2.

Moreover, as illustrated in FIGS. 5 and 11A to 13, the main connector portion 36 is positioned on the inner side of the second box frame 9 of the top case 3 and runs along the inner surface of the peripheral portion 13*a* (a second inner surface) of the main case portion 13. The first face 37*a* of the sealing portion 37 contacts the upper end of the peripheral portion 6*a* of the bottom case 2 and is formed running parallel to the main connector portion 36.

As illustrated in FIGS. 5 and 11A to 13, the connector pressing portions 38 are formed at prescribed locations in the main connector portion 36 such that when the upper end of the peripheral portion 6*a* of the bottom case 2 contacts the first face 37*a* of the sealing portion 37, the outer surface of the peripheral portion 6*a* of the bottom case 2 and the second face 37*b* of the sealing portion 37 are pressed against the inner surface of the peripheral portion 13*a* of the top case 3. Each of the connector mounting portions 39 is formed to have a substantially angular prism shape with a screw insertion hole 39*a* formed in the bottom end of the connector mounting portion 39 and going vertically therethrough.

As illustrated in FIGS. 5 and 11A to 12B, the bottom ends of the second mounting portions 30 in the top cases 3 are inserted into the tops of the connector mounting portions 39, and the bottom end faces of the connector mounting portions 39 contact the first mounting portions 33 of the bottom case 2, with the screw insertion holes 39*a* in the bottom ends of the connector mounting portions 39 aligned with the screw holes 30*a* in the second mounting portions 30.

In this way, as illustrated in FIGS. 11A to 12B, the bottom ends of the second mounting portions 30 in the top cases 3 are inserted into the tops of the connector mounting portions 39, thereby keeping the box connectors 35 in place relative to the top cases 3. Moreover, once the bottom ends of the second mounting portions 30 in the top cases 3 are inserted into the tops of the connector mounting portions 39 and the bottom end faces of the connector mounting portions 39 are brought into contact with the first mounting portions 33 of the bottom case 2, screws 34 are used to fix the box connectors 35 in place between the bottom case 2 and the top cases 3.

In other words, as illustrated in FIGS. 11A to 12B, once the bottom ends of the second mounting portions 30 in the top cases 3 are inserted into the tops of the connector mounting portions 39 and the bottom end faces of the connector mounting portions 39 are brought into contact with the first mounting portions 33 of the bottom case 2, the screws 34 are inserted from the bottom side of the bottom case 2 into the first mounting portions 33 in the bottom case 2, and then the tips of the screws 34 are inserted through the screw insertion holes 39*a* in the connector mounting portions 39 and threaded into the screw holes 30*a* in the second mounting portions 30. This fixes the box connectors 35 between the bottom case 2 and the top cases 3, thereby connecting and fixing together the bottom case 2 and the top cases 3.

As illustrated in FIGS. 5 to 11B, the outer face 40*a* of the corner piece 40 is formed to have the same arc shape as the corner of the peripheral portion 13*a* at the intersection between the upper and side portions of the second box frame 9 of the top case 3, and the inner face 40*b* of the corner piece 40 is formed to have the same arc shape as the corner of the peripheral portion 6*a* at the intersection between the upper and side portions of the first box frame 6 of the bottom case 2.

In this way, as illustrated in FIG. 5, when the box connectors 35 are arranged between the bottom case 2 and the top cases 3, the outer faces 40*a* of the corner pieces 40 fit tightly into the corners of the peripheral portions 13*a* of the second box frames 9 of the top cases 3, and the inner faces 40*b* of the corner pieces 40 fit tightly onto the corners of the peripheral portions 6*a* of the first box frames 6 of the bottom case 2.

Furthermore, as illustrated in FIG. 5, when the corner pieces 40 are arranged between the corners of the peripheral portions 13*a* of the second box frames 9 of the top cases 3 and the corners of the peripheral portions 6*a* of the first box frames 6 of the bottom case 2, the corner pieces 40 fill the gaps between the corners of the peripheral portions 13*a* of the second box frames 9 and the corners of the peripheral portions 6*a* of the first box frames 6.

Meanwhile, as illustrated in FIG. 4, the upper surfaces of the box extensions 14 of the top cases 3 are formed to have a stepped shape that decreases in height moving from the keyboard 5 side of the bottom case 2 towards the rear surface side of the bottom case 2 in order to provide increased strength. Moreover, frame-shaped extension ribs 14*a* are formed in the bottom surfaces of the box extensions 14 at positions aligning with the first frame-shaped ribs 6*b* of the first box frames 6 of the bottom case 2.

In this way, as illustrated in FIGS. 2 to 5, when the top cases 3 are placed on top of the bottom case 2, the frame-shaped extension ribs 14*a* of the box extensions 14 contact the first frame-shaped ribs 6*b* formed in the first box frames 6 of the bottom case 2, with the gaskets 8 interposed therebetween, and the extension bosses 31 in the box extensions 14 are aligned with the first mounting portions 33 in the bottom case 2. The extension bosses 31 are then fastened to the first mounting portions 33 in the bottom case 2 with screws.

Furthermore, as illustrated in FIGS. 4 to 6, the cover 15 of each top case 3 includes a keyboard cover that covers the rear ends of the white keys 5*a* and the black keys 5*b* on the left or right side of the keyboard 5 and a mounting portion cover that covers the respective side of the keyboard mounting portion 2*a* of the bottom case 2 positioned on the respective side of the keyboard 5. When the top cases 3 are placed on top of the bottom case 2, the cover bosses 32 of the covers 15 align with the first mounting portions 33 in the bottom case 2, and the cover bosses 32 are then fastened to the first mounting portions 33 in the bottom case 2 with screws.

As illustrated in FIGS. 1 and 2, the center panel 4 includes an upper surface panel and a rear surface panel, which are formed as a single integrated body and made of a synthetic resin. The center panel 4 is arranged and attached between the main case portions 13 of the top cases 3 that are arranged on both rear sides of the bottom case 2 so as to cover the battery compartment 7 of the bottom case 2 and the box extensions 14 of the top cases 3.

Next, the assembly of the electronic keyboard will be described.

First, the keyboard 5 is mounted to the keyboard mounting portion 2*a* of the bottom case 2, and the gaskets 8 are attached running around the entire upper ends of the first box frames 6 of the bottom case 2 (that is, around the entire upper ends of the peripheral portions 6*a* and the first frame-shaped ribs 6*b* on the upper and left and right sides of the bottom case 2 (see FIG. 12A)). Then, the speakers 10, the tweeters 11, and the bass reflex ports 12 are installed inside of the top cases 3.

To attach each speaker 10 to the main case portion 13 of the respective top case 3, first, the speaker cushioning members 20 are seated inside the mounting holes 10*a* formed in the four corners of each speaker 10. Here, the speaker cushioning members 20 are elastically deformed and inserted into the mounting holes 10*a* in the speaker 10 such that the peripheries of the mounting holes 10*a* are seated within and sandwiched by the seating grooves 20*a* of the speaker cushioning members 20.

Next, the upper face of the speaker 10 is fitted onto the speaker opening 16 formed in the upper surface of the main case portion 13 of the top case 3, and the screw insertion holes 20*b* in the speaker cushioning members 20 that are seated in the mounting holes 10*a* are aligned with the speaker mounting bosses 16*a* in the top case 3. Then, screws (not illustrated in the figures) are threaded through the screw insertion holes 20*b* in the speaker cushioning members 20 and into the speaker mounting bosses 16*a*. In this way, the speakers 10 are attached to the inner surfaces of the top cases 3, with the speaker cushioning members 20 interposed therebetween. The speaker cushioning members 20 therefore form an airtight seal between the speakers 10 and the speaker openings 16.

Then, to attach each tweeter 11 to the main case portion 13 of the respective top case 3, the tweeter cushioning member 22 is arranged around the periphery of the tweeter opening 17 formed in the main case portion 13 of the top case 3. The tweeter 11 is then held in place by the tweeter mounting member 21 with the tweeter mounting member 21 aligned with the tweeter mounting bosses 17*a* of the top case 3.

In this state, the tweeter cushioning member 22 is sandwiched between the tweeter 11 and the main case portion 13 of the top case 3, and the mounting holes 21*a* in the tweeter mounting member 21 are aligned with the tweeter mounting bosses 17*a*. Screws (not illustrated in the figures) are then threaded through the mounting holes 21*a* in the tweeter mounting member 21 and into the tweeter mounting bosses 17*a*. In this way, the tweeters 11 are attached to the inner surfaces of the top cases 3, with the tweeter cushioning members 22 interposed therebetween. The tweeter cushioning members 22 therefore form an airtight seal between the tweeters 11 and the tweeter openings 17.

Next, to attach each bass reflex port 12 to the respective top case 3, the port mounting portion 23 of the bass reflex port 12 is fitted onto the port opening 18 formed in the rear surface of the main case portion 13 of the top case 3, with the port 24 arranged between the speaker 10 and the tweeter 11. Here, the port cushioning member 25 is arranged between the port mounting portion 23 and the rear surface of the main case portion 13.

Then, the port mounting bosses 23*b* formed in the port mounting portion 23 are aligned with the port mounting holes 18*a* formed in the main case portion 13 of the top case 3, and the cutouts 26*a* of the port fastening tab 26 formed in the upper end of the port mounting portion 23 are aligned with the port mounting bosses 27 formed in the main case portion 13 of the top case 3.

Next, screws (not illustrated in the figures) are threaded through the port mounting holes 18*a* in the main case portion 13 and into the port mounting bosses 23*b* in the port mounting portion 23. In this way, the port mounting portion 23 is attached to the rear surface of the main case portion 13, with the port cushioning member 25 sandwiched between the port mounting portion 23 and the rear surface of the main case portion 13.

Then, screws (not illustrated in the figures) are threaded through the cutouts 26*a* in the port fastening tab 26 and into the port mounting bosses 27 in order to fasten the port fastening tab 26 to the port mounting bosses 27. In this way, the bass reflex ports 12 are attached to the main case portions 13 of the top cases 3, with the port cushioning members 25 interposed therebetween. The port cushioning members 25 therefore form an airtight seal between the bass reflex ports 12 and the port openings 18.

Next, the box connectors 35 are arranged in the main case portions 13 of the top cases 3, and the top cases 3 are attached to the bottom case 2. When each box connector 35 is arranged in the main case portion 13 of the respective top case 3, the main connector portion 36 and the sealing portion 37 are arranged running along the inner surface of the peripheral portion 13*a* of the main case portion 13 to the second box frame 9 of the main case portion 13.

Here, the connector mounting portions 39 are aligned with the second mounting portions 30 in the main case portion 13. Then, the bottom ends of the second mounting portions 30 in the top case 3 are inserted into the tops of the connector mounting portions 39, thereby keeping the box connector 35 in place relative to the top case 3. Next, the outer face 40*a* of the corner piece 40 is arranged fitting tightly into the corner of the peripheral portion 13*a* of the main case portion 13 of the top case 3. The box connector 35 is thus arranged in the main case portions 13 in this way.

Then, the top cases 3 are aligned with and placed on top of the first box frames 6 of the bottom case 2. Here, the second box frames 9 of the top cases 3 are aligned with the first box frames 6 of the bottom case 2. Moreover, the keyboard covers 15*a* of the covers 15 of the top cases 3 are fitted over the rear ends of the white keys 5*a* and the black keys 5*b* on the left and right sides of the keyboard 5, and the mounting portion covers 15*b* of the covers 15 are fitted over the sides of the keyboard mounting portion 2*a* of the bottom case 2 positioned on the sides of the keyboard 5.

In this way, the first frame-shaped ribs 6*b* (which are part of the first box frames 6 of the bottom case 2) are aligned with the second frame-shaped ribs 13*b* of the main case portions 13 and the frame-shaped extension ribs 14*a* of the box extensions 14 (which are both part of the second box frames 9 of the top cases 3). Here, the gaskets 8 are sandwiched between the first frame-shaped ribs 6*b* of the bottom case 2 and the second frame-shaped ribs 13*b* of the main case portions 13 as well as the frame-shaped extension ribs 14*a* of the box extensions 14.

Moreover, the upper ends of the peripheral portions 6*a* that are positioned on the upper side and left and right sides and that are another part of the first box frame 6 of the bottom case 2 contact the sealing portions 37 of the box connectors 35 arranged in the top cases 3 as well as the port contacting portions 28*a* formed in the port mounting portions 23 of the bass reflex ports 12, with the gaskets 8 interposed therebetween. Furthermore, the plurality of first mounting portions 33 formed in the bottom case 2 are respectively aligned with the plurality of second mounting portions 30, the plurality of extension bosses 31, and the plurality of cover bosses 32 formed in the top cases 3.

Here, the second mounting portions 30 of the top cases 3 are inserted into the connector mounting portions 39 of the box connectors 35. As a result, the connector mounting portions 39 are sandwiched between the second mounting portions 30 of the top cases 3 and the first mounting portions 33 of the bottom case 2, with the second mounting portions 30 aligned with the first mounting portions 33. Moreover, the connector pressing portions 38 of the box connectors 35 press the outer surfaces of the peripheral portions 6*a* of the bottom case 2 against the inner surfaces of the peripheral portions 13*a* of the main case portions 13, with the gaskets 8 interposed therebetween.

Furthermore, similar to the box connectors 35, the port pressing ribs 28*b* formed in the port mounting portions 23 of the bass reflex ports 12 press the outer surfaces of the peripheral portions 6*a* positioned along the rear surface of the bottom case 2 against the inner surfaces of the peripheral portions 13*a* positioned along the rear surfaces of the main case portions 13 of the top case 3, with the gaskets 8 interposed therebetween.

Next, the screws 34 are respectively inserted into the plurality of first mounting portions 33 in the bottom case 2 from the bottom side of the bottom case 2, and then the tips of the screws 34 are inserted through the screw insertion holes 33*a* in the first mounting portions 33 and threaded into and fastened to the screw holes 30*a*, 31*a*, and 32*a* in the plurality of second mounting portions 30, the plurality of extension bosses 31, and the plurality of cover bosses 32 formed in the top cases 3.

Here, the first mounting portions 33 of the bottom case 2 and the second mounting portions 30 of the top cases 3 are aligned with the connector mounting portions 39 of the box connectors 35, and the tips of the screws 34 are inserted through the screw insertion holes 33*a* in the first mounting portions 33, through the screw insertion holes 39*a* in the connector mounting portions 39 of the box connectors 35, and then threaded into and fastened to the second mounting portions 30 of the top cases 3. As a result, the box connectors 35 are fixed in place and sandwiched between the bottom case 2 and the top cases 3.

Here, the upper ends of the peripheral portions 6*a* of the bottom case 2 that fit into the box connectors 35 press the gaskets 8 into the sealing portions 37 of the box connectors 35, thereby forming an airtight seal in this portion. Moreover, the upper ends of the peripheral portions 6*a* of the bottom case 2 that fit onto the bass reflex ports 12 press the gaskets 8 into the port contacting portions 28*a* of the port mounting portions 23, thereby forming an airtight seal in this portion as well.

Furthermore, the corner pieces 40 of the box connectors 35 are arranged between the corresponding corners of the peripheral portions 13*a* of the main case portions 13 of the top cases 3 and the corresponding corners of the peripheral portions 6*a* of the bottom case 2, with the outer faces 40*a* of the corner pieces 40 fitting tightly into the corners of the peripheral portions 13*a* of the main case portions 13 and the inner faces 40*b* of the corner pieces 40 fitting tightly onto the corners of the peripheral portions 6*a* of the bottom case 2. In this way, airtight seals are formed in the corners of the top cases 3 and the bottom case 2.

Moreover, the first box frames 6 of the bottom case 2 and the second box frames 9 of the top cases 3 sandwich together the gaskets 8. In other words, the second frame-shaped ribs 13*b* of the main case portions 13 and the frame-shaped extension ribs 14*a* of the box extensions 14 (which are both part of the second box frames 9 of the top cases 3) press the gaskets 8 into the first frame-shaped ribs 6*b* (which are part of the first box frames 6 of the bottom case 2).

In this way, the first box frames 6 of the bottom case 2 and the second box frames 9 of the top cases 3 that are aligned therewith form the airtight speaker boxes 1*a* inside of the musical instrument case 1. The speaker boxes 1*a* are formed to have large capacity as well as sufficient tolerance of high sound pressures.

Next, the center panel 4 is arranged and attached between the main case portions 13 of the top cases 3 that are arranged on both rear sides of the bottom case 2. In this way, the battery compartment 7 of the bottom case 2 and the box extensions 14 of the top cases 3 are covered by the center panel 4. Thus, when the top cases 3 are placed on top of and attached to the bottom case 2, the airtight speaker boxes 1*a* are formed therewithin. This completes the assembly of the musical instrument case 1.

Figure 14A:
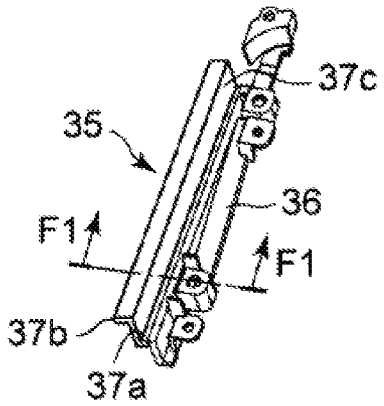
FIGS. 14A to 14C illustrate a modification example of the connector illustrated in FIG. 5.
Figure 14B:
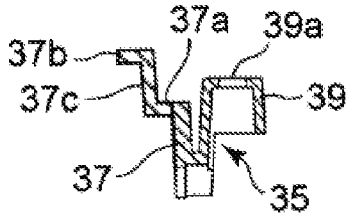
Figure 14C:
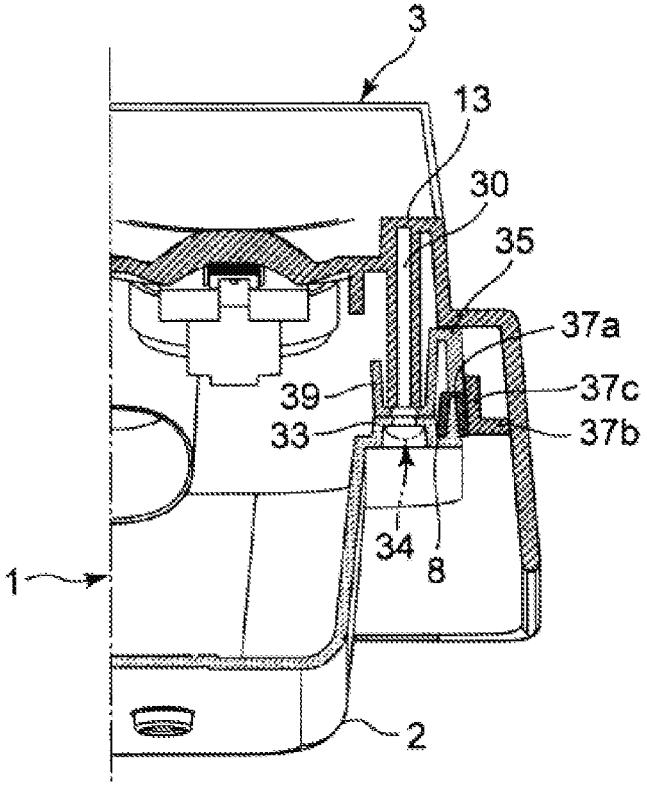

FIGS. 14A to 14C illustrate a modification example of the box connector 35 for when the external shape of the top case 3 is of a larger size. FIG. 14A is an enlarged perspective view of the box connector 35. FIG. 14B is an enlarged cross-sectional view of the main portions of the connector as taken along line F1-F1, and FIG. 14C is an enlarged cross-sectional view of the main components of a top case that uses the box connector 35 as taken along line E1-E1.

Here, in the sealing portion 37, an extension 37*c* is formed on the first face 37*a* that contacts the end of the peripheral portion of the bottom case 2, and the end face of this extension functions as the second face 37*b* that faces the inner surface of the peripheral portion of the respective top case 3. Here, the upper end of the peripheral portion 6*a* of the bottom case 2 contacts the first face 37*a* of the sealing portion 37, with the gasket 8 interposed therebetween, and the second face 37*b* of the sealing portion 37 is pressed against the inner surface of the peripheral portion 13*a* of the top case 3.

Here, the musical instrument case 1 for the electronic keyboard includes the bottom case 2, the top cases 3 that have external shapes larger than the external shape of the bottom case 2, speaker boxes 1*a* that are formed inside of the top cases 3 and the bottom case 2 when the top cases 3 are placed on top of the bottom case 2, and the box connectors 35 that are arranged fitting into the speaker boxes 1*a* in the top cases 3 so as to contact the ends of the peripheral portions 6*a* of the bottom case 2 and fix together the bottom case 2 and the top cases 3. This makes it possible to seal the speaker boxes 1*a* in an airtight manner even when the external shapes of the bottom case 2 and the top cases 3 that are stacked together are different and also makes it possible to achieve a large capacity and tolerance to high sound pressures in the speaker boxes 1*a*.

In other words, in the musical instrument case 1, even when the external shapes of the top cases 3 are formed to be larger than the external shape of the bottom case 2, arranging the box connectors 35 between the peripheral portions 6*a* of the bottom case 2 and the peripheral portions 13*a* of the top cases 3 seals the gaps between the peripheral portions of the bottom case 2 and the inner surfaces of the peripheral portions of the top cases 3 in an airtight manner. Furthermore, this configuration makes it possible to fix together the bottom case 2 and the top cases 3.

Therefore, in the musical instrument case 1, even when gaps are present between the peripheral portions 6*a* of the bottom case 2 and the peripheral portions 13*a* of the top cases 3 due to the bottom case 2 and the top cases 3 that are stacked together having different shapes, those gaps can be reliably and satisfactorily be filled by the box connectors 35, thereby making it possible to reliably and satisfactorily seal the speaker boxes 1*a* in an airtight manner even when the bottom case 2 and the top cases 3 that are stacked together have different shapes. This, in turn, makes it possible to achieve large capacity and tolerance to high sound pressures and also makes it possible to use the bottom case 2 that has a smaller external shape than the top cases 3 in musical instrument cases 1 of different shapes as well.

Here, the box connectors 35 each include the main connector portion 36 that is arranged in the respective top case 3, the sealing portion 37 that is contacted by the upper end of the respective peripheral portion 6*a* of the bottom case 2, and the connector mounting portions 39 that are arranged between and fix together the first mounting portions 33 of the bottom case 2 and the second mounting portions 30 of the top case 3. This makes it possible to reliably fix together the bottom case 2 and the top cases 3, thereby making it possible to seal any gaps between the peripheral portions 6*a* of the bottom case 2 and the peripheral portions 13*a* of the top cases 3 in an airtight manner.

In other words, when the box connectors 35 are arranged in the main case portions 13 of the top cases 3, inserting the bottom ends of the second mounting portions 30 of the top cases 3 into the tops of the connector mounting portions 39 makes it possible to keep the box connectors 35 in place relative to the top cases 3 and also makes it possible to bring the upper ends of the peripheral portions 6*a* of the bottom case 2 into contact with the sealing portions 37 when the top cases 3 are placed on top of the bottom case 2, thereby making it possible to seal any gaps between the peripheral portions 6*a* of the bottom case 2 and the peripheral portions 13*a* of the top cases 3 in an airtight manner.

Here, the box connectors 35 include the connector pressing portions 38 that press the outer surfaces of the peripheral portions 6*a* of the bottom case 2 against the inner surfaces of the peripheral portions 13*a* of the top cases 3 when the upper ends of the peripheral portions 6*a* of the bottom case 2 contact the sealing portions 37. This makes it possible for the connector pressing portions 38 to reliably press the outer surfaces of the peripheral portions 6*a* of the bottom case 2 into the inner surfaces of the peripheral portions 13*a* of the top cases 3 when the top cases 3 are placed on top of the bottom case 2, thereby again making it possible to seal any gaps between the peripheral portions 6*a* of the bottom case 2 and the peripheral portions 13*a* of the top cases 3 in an airtight manner.

Furthermore, arranging the connector mounting portions 39 of the box connectors 35 between the first mounting portions 33 of the bottom case 2 and the second mounting portions 30 of the top cases 3 and then fastening these components together using the screws 34 (screw members) that go through the first mounting portions 33, the connector mounting portions 39, and the second mounting portions 30 makes it possible to reliably and securely fix together the bottom case 2 and the top cases 3 with the connector mounting portions 39 sandwiched therebetween. This makes it possible to reliably bring the upper ends of the peripheral portions 6*a* of the bottom case 2 into contact with the sealing portions 37 and also makes it possible for the connector pressing portions 38 to reliably press the outer surfaces of the peripheral portions 6*a* of the bottom case 2 into the inner surfaces of the peripheral portions 13*a* of the top cases 3.

Here, the box connectors 35 also include the corner pieces 40 that are arranged between the corners of the peripheral portions 13*a* of the top cases 3 and the corners of the peripheral portions 6*a* of the bottom case 2. This makes it possible for the outer faces 40*a* to fit tightly into the corners of the peripheral portions 13*a* of the second box frames 9 of the top cases 3 and also makes it possible for the inner faces 40*b* to fit tightly onto the corners of the peripheral portions 6*a* of the first box frames 6 of the bottom case 2 when the box connectors 35 are arranged between the corners of the peripheral portions 6*a* of the bottom case 2 and the corners of the peripheral portions 13*a* of the top cases 3, thereby making it possible to satisfactorily seal any gaps between the corners of the peripheral portions 13*a* of the top cases 3 and the corners of the peripheral portions 6*a* of the bottom case 2 in an airtight manner.

Moreover, the speaker boxes 1*a* in the musical instrument case 1 are enclosed by the first box frames 6 that include the peripheral portions 6*a* of the bottom case 2 and the first frame-shaped ribs 6*b* formed in the bottom case 2 and by the second box frames 9 that include the second frame-shaped ribs 13*b* formed in the top cases 3 and the box connectors 35. This makes it possible to easily and satisfactorily form the airtight speaker boxes 1*a* simply by placing the top cases 3 on top of the bottom case 2.

Here, in the speaker boxes 1*a* of the musical instrument case 1, the gaskets 8 are arranged running around the entire peripheries between the first box frames 6 and the second box frames 9. This makes it possible to sandwich the gaskets 8 between the first box frames 6 of the bottom case 2 and the second box frames 9 of the top cases 3 when the top cases 3 are placed on top of the bottom case 2, thereby making it possible to reliably and satisfactorily seal the speaker boxes 1*a* enclosed by the top cases 3 and the bottom case 2 in an airtight manner.

In other words, arranging the gaskets 8 running around the entire peripheries of the first box frames 6 of the bottom case 2 makes it possible to reliably and satisfactorily sandwich the gaskets 8 between the peripheral portions 6*a* and the first frame-shaped ribs 6*b* of the bottom case 2, the second frame-shaped ribs 13*b* and the frame-shaped extension ribs 14*a* formed in the top cases 3, and the sealing portions 37 of the box connectors 35 when the top cases 3 are placed on top of the bottom case 2, thereby making it possible to seal the speaker boxes 1*a* in an airtight manner.

This configuration makes it possible to press the gaskets 8 into the sealing portions 37 of the box connectors 35 when the top cases 3 are placed on top of the bottom case 2 and the upper ends of the peripheral portions 6*a* of the bottom case 2 contact the sealing portions 37 and also makes it possible to sandwich the gaskets 8 between the outer surfaces of the peripheral portions 6*a* of the bottom case 2 and the inner surfaces of the peripheral portions 13*a* of the top cases 3 when the connector pressing portions 38 press the outer surfaces of the peripheral portions 6*a* of the bottom case 2 against the inner surfaces of the peripheral portions 13*a* of the top cases 3, thereby making it possible to further increase the airtightness of the seal formed by the box connectors 35.

Furthermore, in the speaker boxes 1*a* of the musical instrument case 1, the top cases 3 include the box extensions 14 that are formed to have a stepped shape. This makes it possible to increase the volumes of the speaker boxes, thereby making it possible to enhance the acoustics of the speakers 10. Moreover, forming the box extensions 14 to have these stepped shapes makes it possible to provide sufficient strength even when the box extensions 14 are formed as integrated parts of the top cases 3, thereby again making it possible to enhance the acoustics.

Furthermore, in the musical instrument case 1, the speaker boxes 1*a* are formed by the peripheral portions 6*a* of the bottom case 2 and the first frame-shaped ribs 6*b* formed in the bottom case 2, the peripheral portions 13*a* of the top cases 3 and the second frame-shaped ribs 13*b* and the frame-shaped extension ribs 14*a* formed in the top cases 3, and the sealing portions 37 of the box connectors 35. Moreover, the speakers 10, and tweeters 11, and the bass reflex ports 12 are mounted to the inner surfaces of the top cases 3 in the speaker boxes 1*a*. This makes it possible to enhance the acoustics of the speakers 10, and tweeters 11, and the bass reflex ports 12.

Here, the bass reflex ports 12 are fitted over the port openings 18 formed in the rear surfaces of the top cases 3 of the speaker boxes and then attached to the inner sides of those rear surfaces. This makes it possible to enhance the acoustics even when using bass reflex ports 12 that are fitted over the port openings 18 and attached to the rear surfaces of the top cases 3.

In other words, the bass reflex ports 12 each include the port mounting portion 23 that is fitted over the respective port opening 18 and attached to the inner side of the rear surface of the respective top case 3 and the tube-shaped port 24 that is formed integrated with the port mounting portion 23 and that is open to the outside of the top case 3 via the port opening 18. This makes it possible for the tube-shaped ports 24 to satisfactorily enhance the acoustics.

Moreover, the port cushioning members 25 are arranged between the inner sides of the rear surfaces of the top cases 3 and the port mounting portions 23 that are mounted thereto except for in the locations corresponding to the port openings 18. This makes it possible to reliably and satisfactorily mount the bass reflex ports 12, with the port cushioning members 25 forming airtight seals between the port mounting portions 23 and the inner sides of the rear surfaces of the top cases 3 and without the port cushioning members 25 blocking the port openings 18.

Furthermore, in the port mounting portions 23 of the bass reflex ports 12, the port connectors 28 are formed in the bottom ends of the port mounting portions 23 that fit onto the bottom case 2. Similar to with the box connectors 35, this makes it possible to maintain an airtight seal even when the shapes of the bottom case 2 and the top cases 3 that are stacked together are different.

In other words, even when the external shapes of the top cases 3 are larger than the external shape of the bottom case 2, the port mounting portions 23 of the bass reflex ports 12 make it possible to bring the ends of the peripheral portions 6*a* of the bottom case 2 into contact with the port connectors 28 and also make it possible for the port connectors 28 to press the outer surfaces of the peripheral portions 6*a* of the bottom case 2 against the inner surfaces of the peripheral portions 13*a* of the top cases 3.

Therefore, in the port mounting portions 23 of the bass reflex ports 12, even when gaps are present between the outer surfaces of the peripheral portions 6*a* of the bottom case 2 (to which the bass reflex ports 12 are mounted) and the inner surfaces of the peripheral portions 13*a* of the top cases 3 due to the bottom case 2 and the top cases 3 that are stacked together having different shapes, those gaps can be reliably and satisfactorily filled by the port connectors 28. This makes it possible to seal the speaker boxes 1*a* in an airtight manner even when the bottom case 2 and the top cases 3 that are stacked together have different shapes.

Furthermore, the port mounting portion 23 of each of the bass reflex ports 12 includes the port contacting portion 28*a* and the port pressing ribs 28*b*. This makes it possible for the port pressing ribs 28*b* to press the outer surfaces of the peripheral portions 6*a* of the bottom case 2 against the inner surfaces of the peripheral portions 13*a* of the top cases 3 when the top cases 3 are placed on top of the bottom case 2 and the upper ends of the peripheral portions 6*a* of the bottom case 2 contact the port mounting portions 23, thereby again making it possible to seal any gaps between the peripheral portions 6*a* of the bottom case 2 and the peripheral portions 13*a* of the top cases 3 in an airtight manner.

Here again, in the speaker boxes 1*a*, the gaskets 8 are arranged running around the entire peripheries between the first box frames 6 and the second box frames 9, thereby making it possible to press the gaskets 8 into the port contacting portions 28*a* when the top cases 3 are placed on top of the bottom case 2 such that the upper ends of the peripheral portions 6*a* of the bottom case 2 contact the port contacting portions 28*a* of the port mounting portions 23 of the bass reflex ports 12.

Moreover, in each of the bass reflex ports 12, the port pressing ribs 28*b* are formed on the port contacting portion 28*a*. This makes it possible to sandwich the gaskets 8 between the outer surfaces of the peripheral portions 6*a* of the bottom case 2 and the inner surfaces of the peripheral portions 13*a* of the top cases 3 when the top cases 3 are placed on top of the bottom case 2 such that the port pressing ribs 28*b* press the outer surfaces of the peripheral portions 6*a* of the bottom case 2 against the inner surfaces of the peripheral portions 13*a* of the top cases 3, thereby making it possible to further increase the airtightness of the seal formed by the port connectors 28.

Note that although the bass reflex ports 12 are mounted to the rear surfaces of the top cases 3 of the speaker boxes 1*a* in the embodiment as described above, the present invention does not necessarily need to include the bass reflex ports 12. In this case, the box connectors 35 may also be arranged between the peripheral portions 13*a* of the top cases 3 and the peripheral portions 6*a* of the bottom case 2 near the rear surfaces of the top cases 3.

Furthermore, the embodiment as described above is an example of applying the present invention to an electronic keyboard. However, the present invention does not necessarily need to be applied to an electronic keyboard and may also be applied to other electronic musical instruments such as electronic stringed instruments, for example. Moreover, the present invention does not necessarily need to be applied to an electronic musical instrument and may be applied to a wide variety of audio devices or the like that include speakers.

Although an embodiment of the present invention was described above, the present invention is not limited to this embodiment and includes all inventions included in the scope of the claims as well as their equivalents.

The present invention was described using the specific embodiment above as an example. However, the technical scope of the present invention is not limited to the embodiment described above. The scope of the present invention is not limited to the embodiment described above, and any configurations included in the scope of the claims and their equivalents are also encompassed by the present invention.

It is understood to persons skilled in the art that various modifications or improvements can be made to the specific embodiment described above, and such modifications and improvements are included within the technical scope of the present invention as defined by the claims.

What is claimed is:

1. An electronic musical instrument, comprising:

a device case including:

a lower case having a first mounting portion;

an upper case having a second mounting portion facing the first mounting portion;

a connector positioned inside the upper case and having a sealing portion that seals in an airtight manner a gap between a peripheral portion of the lower case and an inner surface of a peripheral portion of the upper case, said connector further having a mounting portion positioned between the first mounting portion and the second mounting portion; and a fixing member that fixes together the first mounting portion, the mounting portion of the connector, and the second mounting portion so as to couple the upper case with the lower case and to define a speaker box that accommodates a speaker within a space enclosed by the upper case and the lower case, and a keyboard exposed to outside of the lower case.

2. The electronic musical instrument according to claim 1, wherein, in the device case:

the lower case further includes a gasket covering an end of the peripheral portion of the lower case, and the sealing portion has a first face that faces the end of the peripheral portion of the lower case with the gasket interposed therebetween and a second face that faces a first inner surface of the peripheral portion of the upper case.

3. The electronic musical instrument according to claim 2, wherein, in the device case:

the connector further includes a main connector portion that faces a second inner surface of the peripheral portion of the upper case, and when the first face of the sealing portion contacts the end of the peripheral portion of the lower case with the gasket interposed therebetween, an outer surface of the peripheral portion of the lower case contacts the first inner surface of the peripheral portion of the upper case, and the second face of the sealing portion contacts the first inner surface of the peripheral portion of the upper case, and the main connector portion contacts the second inner surface of the peripheral portion of the upper case.

4. The electronic musical instrument according to claim 1, wherein, in the device case:

the connector further includes a connector pressing portion that presses an outer surface of the peripheral portion of the lower case against the inner surface of the peripheral portion of the upper case when an end of the peripheral portion of the lower case is facing a first face of the sealing portion.

5. The electronic musical instrument according to claim 2, wherein, in the device case:

the fixing member of the device case includes a screw that is inserted through and fastens together the first mounting portion, the mounting portion of the connector, and the second mounting portion in a state in which the mounting portion of the connector is positioned between the first mounting portion of the lower case and the second mounting portion of the upper case.

6. The electronic musical instrument according to claim 1, wherein the device case further comprises:

a first box frame formed by an end of the peripheral portion of the lower case and a first frame-shaped rib formed within the lower case, and a second box frame formed by the connector and a second frame-shaped rib formed in the upper case.

7. The electronic musical instrument according to claim 6, wherein, in the device case:

a gasket is arranged running around an entire periphery between the first box frame and the second box frame of the device case.

8. The electronic musical instrument according to claim 7, wherein, in the device case:

the second box frame includes a box extension formed having a stepped shape in the upper case.

9. The electronic musical instrument according to claim 8, wherein, in the device case:

said speaker, a tweeter, and a bass reflex port that are arranged in a space enclosed by the first box frame and the second box frame of the device case.

10. A device case, comprising:

a lower case having a first mounting portion;

a top case having a second mounting portion facing the first mounting portion;

a connector positioned inside the top case and having a sealing portion that seals in an airtight manner a gap between a peripheral portion of the lower case and an inner surface of a peripheral portion of the top case, said connector further having a mounting portion positioned between the first mounting portion and the second mounting portion; and a fixing member that fixes together the first mounting portion, the mounting portion of the connector, and the second mounting portion, wherein the connector further includes a connector pressing portion that presses an outer surface of the peripheral portion of the lower case against the inner surface of the peripheral portion of the upper case when an end of the peripheral portion of the lower case is facing a first face of the sealing portion.

11. The device case according to claim 10, wherein the lower case further includes a gasket covering an end of the peripheral portion of the lower case, and wherein the sealing portion has a first face that faces the end of the peripheral portion of the lower case with the gasket interposed therebetween and a second face that faces a first inner surface of the peripheral portion of the upper case.

12. The device case according to claim 11, wherein the fixing member of the device case includes a screw that is inserted through and fastens together the first mounting portion, the mounting portion of the connector, and the second mounting portion in a state in which the mounting portion of the connector is positioned between the first mounting portion of the lower case and the second mounting portion of the upper case.

13. The device case according to claim 10, wherein the device case further includes a first box frame formed by an end of the peripheral portion of the lower case and a first frame-shaped rib formed within the lower case, and a second box frame formed by the connector and a second frame-shaped rib formed in the upper case.

14. The device case according to claim 13, wherein a gasket is arranged running around an entire periphery between the first box frame and the second box frame of the device case.

15. The device case according to claim 14, wherein the second box frame of the device case includes a box extension formed having a stepped shape in the upper case.

16. The device case according to claim 15, wherein a speaker, a tweeter, and a bass reflex port are arranged in a space enclosed by the first box frame and the second box frame of the device case.

17. The device case according to claim 16, wherein the bass reflex port includes a port mounting portion that is mounted to an inner side of a rear surface of the upper case and that is fitted onto an opening formed in that rear surface and a tube-shaped port that is formed integrated with the port mounting portion and that is open to outside of the upper case via the opening.

18. The device case according to claim 17, wherein in the bass reflex port, a cushioning member is arranged between the inner side of the rear surface of the upper case and the port mounting portion that is mounted thereto.

19. The device case according to claim 17, wherein a port connector is formed in an edge of the port mounting portion facing the lower case and is contacted by an end of the peripheral portion of the lower case when the upper case is placed on top of the lower case.

* * * * *